US007008256B2

(12) United States Patent
Poiraud

(10) Patent No.: US 7,008,256 B2
(45) Date of Patent: Mar. 7, 2006

(54) COAXIAL CABLE CONNECTION DEVICE

(75) Inventor: Bernard Poiraud, St Romans (FR)

(73) Assignee: Arnould Fabrique d'Appareillage Electrique, Saint-Marcellin (FR)

( * ) Notice: Subject to any disclaimer, the term of this patent is extended or adjusted under 35 U.S.C. 154(b) by 0 days.

(21) Appl. No.: 10/887,345

(22) Filed: Jul. 9, 2004

(65) Prior Publication Data

US 2005/0042920 A1 Feb. 24, 2005

(30) Foreign Application Priority Data

Jul. 10, 2003 (FR) ..... 03 08472

(51) Int. Cl.
*H01R 4/24* (2006.01)

(52) U.S. Cl. ..... 439/394; 439/578

(58) Field of Classification Search ..... 439/393, 439/394, 578–585, 415, 402, 413, 422; 29/862
See application file for complete search history.

(56) References Cited

U.S. PATENT DOCUMENTS

| | | | | |
|---|---|---|---|---|
| 3,713,079 A | * | 1/1973 | Dechelette | 439/749 |
| 4,708,414 A | * | 11/1987 | Lam | 439/394 |
| 4,717,355 A | | 1/1988 | Mattis | |
| 4,799,900 A | | 1/1989 | Capp et al. | |
| 4,927,378 A | * | 5/1990 | Song | 439/394 |
| 5,021,011 A | * | 6/1991 | Kawanami et al. | 439/582 |
| 5,052,945 A | * | 10/1991 | Shimomura et al. | 439/394 |
| 5,062,804 A | * | 11/1991 | Jamet et al. | 439/394 |
| 5,482,475 A | * | 1/1996 | Kawaguchi | 439/394 |
| 5,657,385 A | | 8/1997 | Reichle | |

FOREIGN PATENT DOCUMENTS

| | | |
|---|---|---|
| DE | 2 046 213 | 3/1972 |
| DE | 20 47 652 | 4/1972 |
| EP | 1 147 574 | 7/2000 |

* cited by examiner

*Primary Examiner*—Alexander Gilman
(74) *Attorney, Agent, or Firm*—Young & Thompson

(57) ABSTRACT

A coaxial cable connection device comprises a compartment for direct insertion of a previously partially bared end of a coaxial cable to be connected. A contact blade in this compartment is elongate in the same direction as the compartment and spears the coaxial cable between its outer jacket and its shield. The device further comprises a contact terminal with which the central core of the coaxial cable is engaged, a base of which the contact blade is part, and a cap fixed to the base in a closed position of the device and comprising a retaining member in the immediate vicinity of the contact blade in the closed position. The retaining member, in the closed position, grips the outer insulative jacket of a cable speared on the blade on the side opposite the blade.

36 Claims, 3 Drawing Sheets

COAXIAL CABLE CONNECTION DEVICE

BACKGROUND OF THE INVENTION

1. Field of the Invention

The invention relates to coaxial cable connection devices.

2. Description of the Prior Art

This kind of device must hold the coaxial cable properly and, separately, make a first electrical contact with the metallic braid usually constituting the internal shield of the coaxial cable and a second electrical contact with its conductive central core. This is known in the art.

French patent application 2 787 936 discloses a connection device of the above kind comprising a compartment adapted for direct insertion of a previously partially bared end of a coaxial cable to be connected, a contact blade in said compartment elongate in the same direction as said compartment and adapted to spear said coaxial cable between an outer jacket thereof and a shield thereof, a cam rotating about a rotation axis oriented parallel to the direction of the compartment, which cam carries a projecting clamping rib with a tip at a varying distance from the cam rotation axis, and a contact terminal with which the central core of the coaxial cable is adapted to be engaged.

With a connection device of the above kind, only the central core of the coaxial cable is bared. In contrast to more conventional connection devices, there is no need to bare the braid to the rear of the bared portion of the central core, which is relatively difficult because it involves removing only the outer jacket.

Once the cable, bared in the above manner, is speared on the contact blade, the cable is locked by turning the cam by one quarter-turn using a screwdriver. The clamping rib on the cam then presses against the insulative outer jacket of the coaxial cable to grip the jacket between the clamping rib and the contact blade, which is sufficient to retain the coaxial cable properly.

The invention aims to improve this kind of device, in particular with regard to its conditions of use.

SUMMARY OF THE INVENTION

To this end it proposes a coaxial cable connection device comprising a compartment adapted for direct insertion of a previously partially bared end of a coaxial cable to be connected, a contact blade in the compartment elongate in the same direction as the compartment and adapted to spear the coaxial cable between an outer jacket thereof and a shield thereof, a contact terminal with which the central core of the coaxial cable is adapted to be engaged, a base of which the contact blade is part, and a cap adapted to be fixed to the base in a closed position of the device and comprising a retaining member in the immediate vicinity of the contact blade in the closed position, which retaining member is adapted, in the closed position, to grip the outer insulative jacket of a cable speared on the blade on the side opposite the blade.

As in the prior art device mentioned above, there is no need to bare the shielding braid of the coaxial cable before insertion into the compartment, which is effected with the connection device open, of course, with the retaining member or members offset from the contact blade.

Thereafter, merely closing the device locks the cable therein thanks to the retaining member or members of the cap gripping the insulative outer jacket.

Thus connecting a coaxial cable to a connection device according to the invention is particularly simple and convenient.

Furthermore, the provision of one or more retaining members directly on the cap means that the connection device according to the invention may be manufactured from a small number of components and/or be particularly compact.

According to features that are preferred for reasons of simplicity and convenience:

- the retaining member is a claw having a pointed end; and/or
- the device further comprises two retaining members each formed by a claw having a pointed end; and where applicable
- the two claws are centered in a longitudinal plane of symmetry of the cap; and/or
- the contact blade has a flat facing each claw; and where applicable
- the flat comprises a central V-shaped profile groove.

According to other features that are preferred for the same reasons:

- the retaining member is a lug having a sharp edge oriented, in the closed position, in a direction transverse to the direction of the compartment; and/or
- the device comprises two retaining members each formed by a lug having a sharp edge oriented, in the closed position, in a direction transverse to the direction of the compartment, the two lugs being situated on respective opposite sides of the contact blade in the closed position; and/or
- the device comprises four retaining members respectively formed by two claws having a pointed end centered in a longitudinal plane of symmetry of said cap and two lugs each having a sharp edge oriented, in said closed position, in a direction transverse to the direction of said compartment; and where applicable
- each lug has two sharp edges disposed at a distance from each other.

According to other features that are preferred for the same reasons:

- the compartment is delimited by a cage comprising a cradle and a first arch and a second arch offset from each other; and where applicable
- the contact blade has the general shape of a fingernail whose concave side faces the cradle and whose convex side faces the first and second arches; and/or
- the cradle and the first arch delimit an entry mouth into the compartment; and where applicable
- the second arch carries the contact blade; and where applicable
- the contact blade is attached to the second arch by a bridge; and/or
- the retaining member is between the first arch and the second arch in the immediate vicinity of the contact blade in the closed position.

According to other features that are preferred for the same reasons:

- the base and the cap are articulated to each other, the device having an open position in which the cap is raised relative to the base, the cap being pivoted onto the base in the closed position; and/or
- the base and the cap are articulated on the side opposite the compartment; and/or
- the base and the cap are articulated in a direction transverse to the direction of the compartment; and/or the base and the cap are articulated by hinge members that are part of the base and pins that are part of the cap.

According to other features that are preferred for the same reasons:

the base and the cap comprise clipping members for fixing them to each other in the closed position; and where applicable the clipping members are situated on respective opposite sides of the contact blade; and/or the clipping members comprise clips forming part of the base; and where applicable the clips form part of a molded plastic material insert of the base; and where applicable the insert comprises a portion disposed between a metal body of the base and the contact terminal, which is part of the base.

According to other features that are preferred for the same reasons and may be used independently of the features set out hereinabove when the connection device comprises a base and a cap:

the contact terminal is part of the base which comprises a conductive material partition at least partially surrounding a portion of the contact terminal in which the central core is adapted to be engaged; and where applicable the cap has a portion forming a dome fitting to one of the ends of the partition in the closed position; and where applicable the cap portion forming a dome comprises a portion of a back wall and a rib; and/or the partition faces, on the inside, a conductive portion of the base and the cap comprises a wall in which one end of the portion nests in the closed position.

According to other features that are preferred for the same reasons:

the contact terminal comprises a lyre contact adapted to interengage with the central core of the cable and a tail forming part of a receptacle for receiving a coaxial cable connection plug; and where applicable the receptacle comprises a tubular member in which the tail is engaged and the base comprises an insulative material insert disposed between a body of which the tubular member is part and the contact terminal; and where applicable the insert comprises a foot accommodated in the tubular member and a head in which the lyre contact is accommodated; and where applicable the head comprises a first compartment in which the lyre contact is accommodated and a second compartment connected to the first compartment by a passage; and where applicable the insert comprises a shield connected to the head on the same side as the first compartment and a hole is formed in the shield through which the conductive core of the coaxial cable is passed; and/or the contact terminal is oriented in a direction transverse to the direction of the compartment.

According to other features that are preferred for their effect of centering the base and the cap, which is favorable to achieving good performance from the device of the invention, either the base or the cap comprises a rib accommodated in a groove or notch in the base or the cap, respectively.

The explanation of the invention now continues with the description of one embodiment given hereinafter by way of nonlimiting and illustrative example and with reference to the appended drawings.

DETAILED DESCRIPTION OF THE PREFERRED EMBODIMENTS

Figures 1, 2:
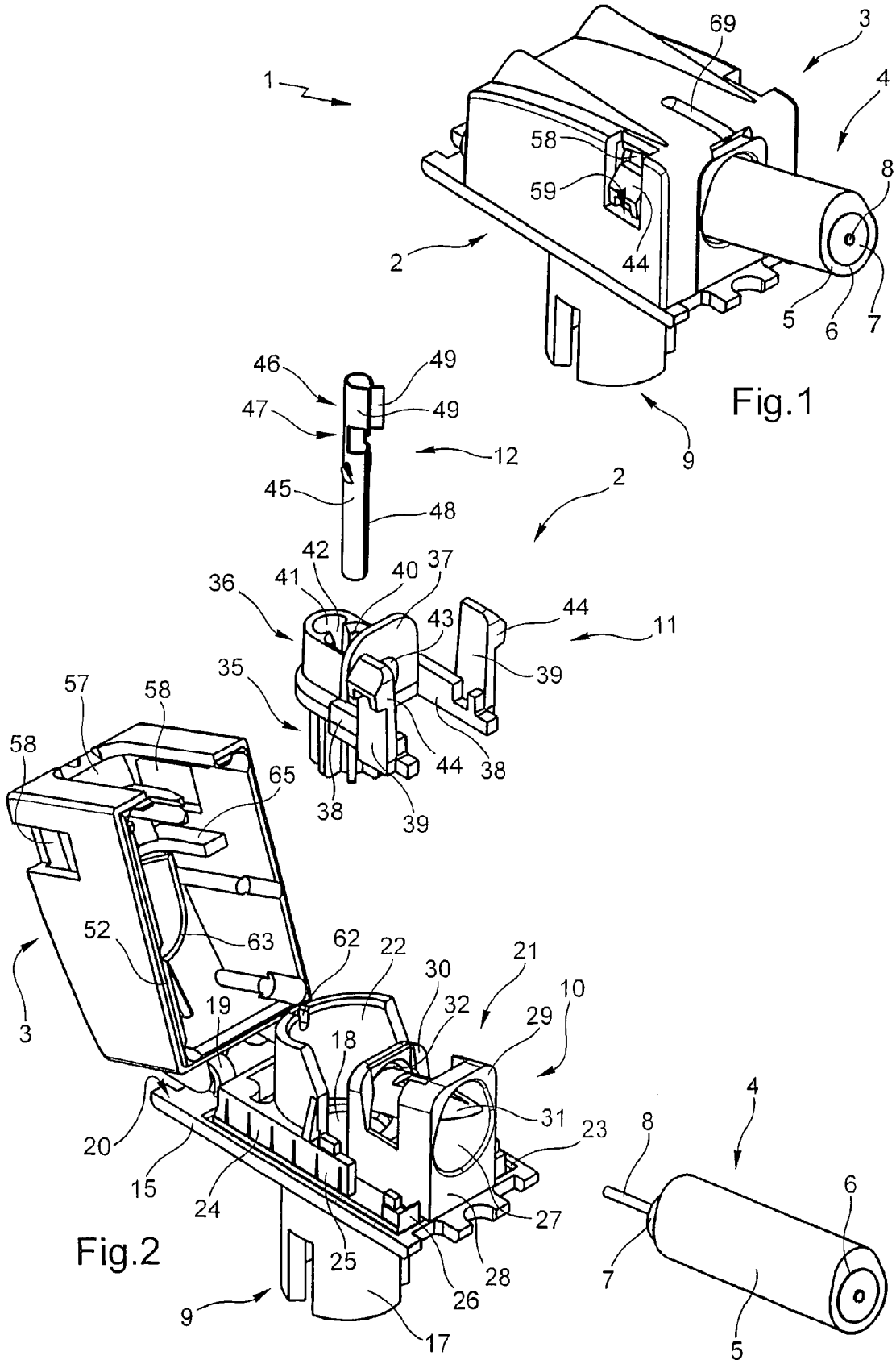
FIG. 1 is a perspective view of a device according to the invention, to which a coaxial cable is connected, this device forming a mechanism for a wall-mounted television or FM radio socket.
FIG. 2 is an exploded perspective view of the device with the cap raised, showing a coaxial cable in position ready to be placed in the base.
Figure 3:
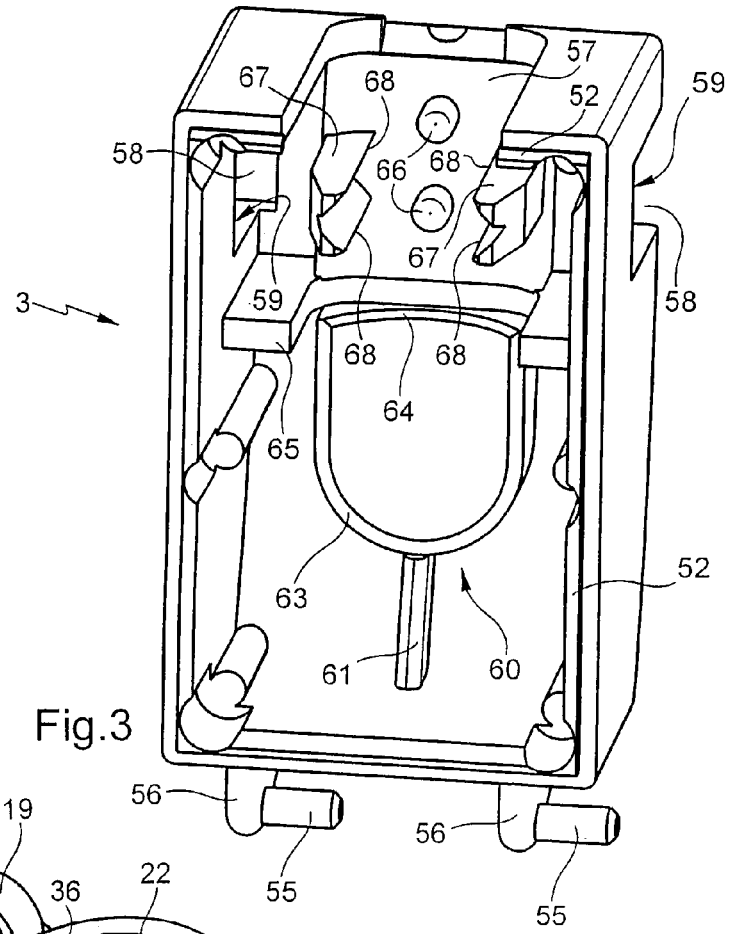
FIG. 3 is a perspective view of the cap, showing its interior from a different angle to FIG. 2.

The device 1 shown in FIGS. 1 to 5 comprises a base 2 and a cap 3. It is intended to be connected to a coaxial cable 4, in this example a cable for distributing television and/or FM radio signals.

This kind of cable has an insulative plastic material outer jacket 5, a braid 6 made of fine conductive metal wires, an insulative plastic material inner sheath 7, and a central core 8 consisting of a relatively rigid conductive metal wire. The inner sheath 7 closely surrounds the core 8, the braid 6 closely surrounds the inner sheath 7, and the outer jacket 5 closely surrounds the braid 6.

The cap 3 and the distribution cable 4 are designed to be disposed on the interior side of the socket while on the external side there is a connector 9 for connecting one end of a cord connecting the socket to a television and/or an FM radio receiver.

As seen more particularly in FIG. 2, the base 2 of the socket 1 comprises a body 10, an insert 11 and a contact terminal 12.

The body 10 is cast from a conductive metal. It comprises a plate 15 having, on the side that is at the bottom in the drawings, a flat face 16 (FIG. 5) from which projects a tubular member 17 that is part of the connector 9.

The plate 15 has a rectangular contour whose width corresponds to a predetermined dimension common to a series of electrical installation accessories, for example a width of the order of 22.5 mm, and whose length is approximately twice its width.

An opening 18 in the plate 15 forms an extension of a bore in the tubular member 17.

In the vicinity of one of the transverse edges of the plate 15 the body 10 has two semicircular hinge members 19 projecting from the face 20 of the plate 15 opposite the face 16. The hinge members 19 are for articulating the cap 3 to the body 10, more generally to the base 2.

From the face 20 of the plate 15 there also projects a cage 21 situated between the opening 18 and the transverse edge of the plate 15 opposite that on which the hinge members 19 are located. The width of the cage 21 is approximately half the width of the plate 15.

Over about half of its circumference, on the side opposite the cage 21, the opening 18 is bordered by a partition 22 whose shape is that of a short length of guttering. The partition 22 projects from the base 20 of the plate 15.

A groove 23 is recessed into the base 20 of the plate 15.

The groove 23 has a generally rectangular shape. One of its shorter sides is oriented in the transverse direction and disposed in the vicinity of the hinge members 19, which are situated between the groove 23 and one of the transverse edges of the plate 15. The two longer sides of the groove 23 are oriented in the longitudinal direction and situated in the vicinity of the lateral edges of the plate 15. The other shorter side of the groove 23 is oriented in the transverse direction and disposed in the vicinity of the transverse edge of the plate 15 adjacent the cage 21, this shorter side being discontinuous in that it is formed of two sections situated on respective opposite sides of the cage 21.

A rib 24, also projecting from the face 20 of the plate 15, is disposed between the groove 23 and the partition 22. The rib 24 runs along the shorter side of the groove 23 situated in the vicinity of the hinge members 19 and a portion of each of the two longer sides of the groove 23.

Beyond the partition 22, the rib 24 is extended along each longer side of the groove 23 and about half way along the cage 21 by a straight wall 25 offset from the cage 21.

Each corner of the groove 23 situated on one side of the cage 21 has a right-angle wall 26 running along it.

Figure 5:
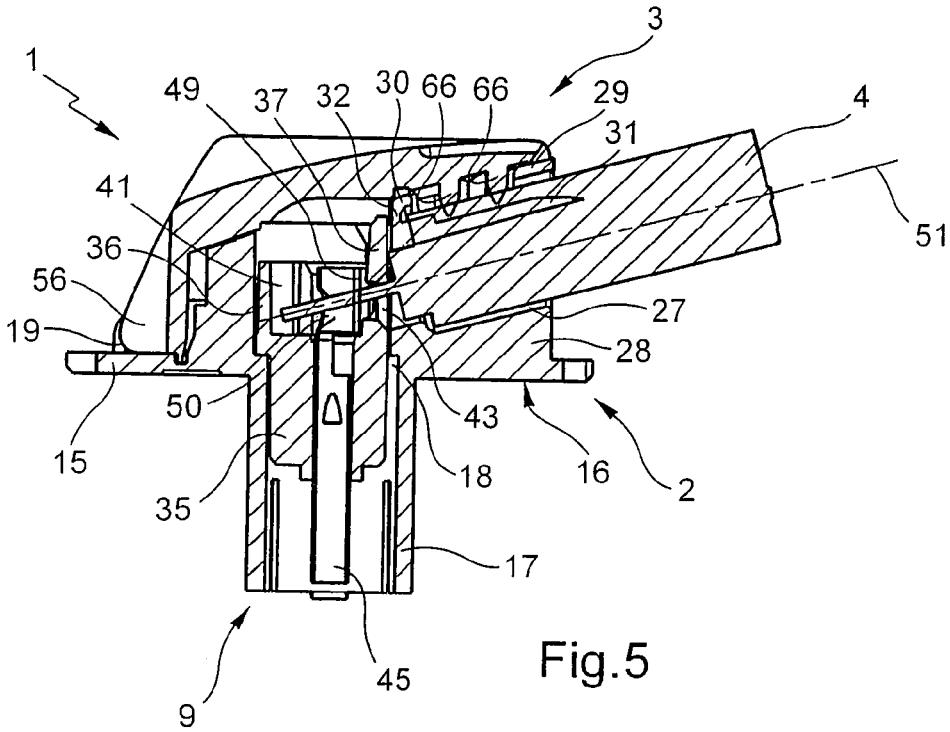
FIG. 5 is a view in elevation of the device shown in FIG. 1 and the cable to which it is connected in section on a longitudinal plane of symmetry.

The cage 21 delimits a compartment 27 with a generally cylindrical contour whose diameter corresponds to the outside diameter of the cable 4 and whose axis 51 is situated in the longitudinal plane of symmetry of the body 10 and inclined toward the plate 15 and toward the opening 18, as seen more particularly in FIG. 5.

Between the plate 15 and the compartment 27 the cage 21 has a solid cradle 28 delimited on the side of the compartment 27 by a semicylindrical surface.

On the side of the transverse edge of the plate 15 opposite the hinge members 19 the cradle 28 is joined to an arch 29 whose inside surface is semicylindrical and extends the inside surface of the cradle 28. Thus the cage 21 has along the transverse edge of the plate 15 opposite the hinge members 19 a continuous cylindrical contour delimiting an entry mouth into the compartment 27.

The cage 21 comprises an arch 30 similar to the arch 29 opposite the arch 29, i.e. on the same side as the opening 18.

The arch 30 carries a contact blade 31 whose general shape is that of a fingernail.

To be more precise, the blade 31 has an arcuate profile whose radius corresponds to that of the braid 6 of the cable 4. The blade 31 is disposed concentrically with the compartment 27. The concave side of the blade 31 faces toward the cradle 28 and its convex side faces toward the arches 29 and 30.

The blade 31 is connected to the arch 30 by a bridge 32 extending between the arch 30 and the end of the blade 31 on the same side as the opening 18 (its proximal end).

As may be seen in FIG. 5, the blade 31 is slightly longer than the remainder of the cage 21, its distal end (the end opposite the bridge 32) projecting slightly beyond the arch 29.

The distal end of the blade 31 is pointed, i.e. its width, to be more precise its angular extent, becomes progressively smaller toward this end. Its edge surface is additionally thinned, i.e. the blade 31 has a thickness that decreases toward its distal end in the vicinity of the latter.

Figure 4:
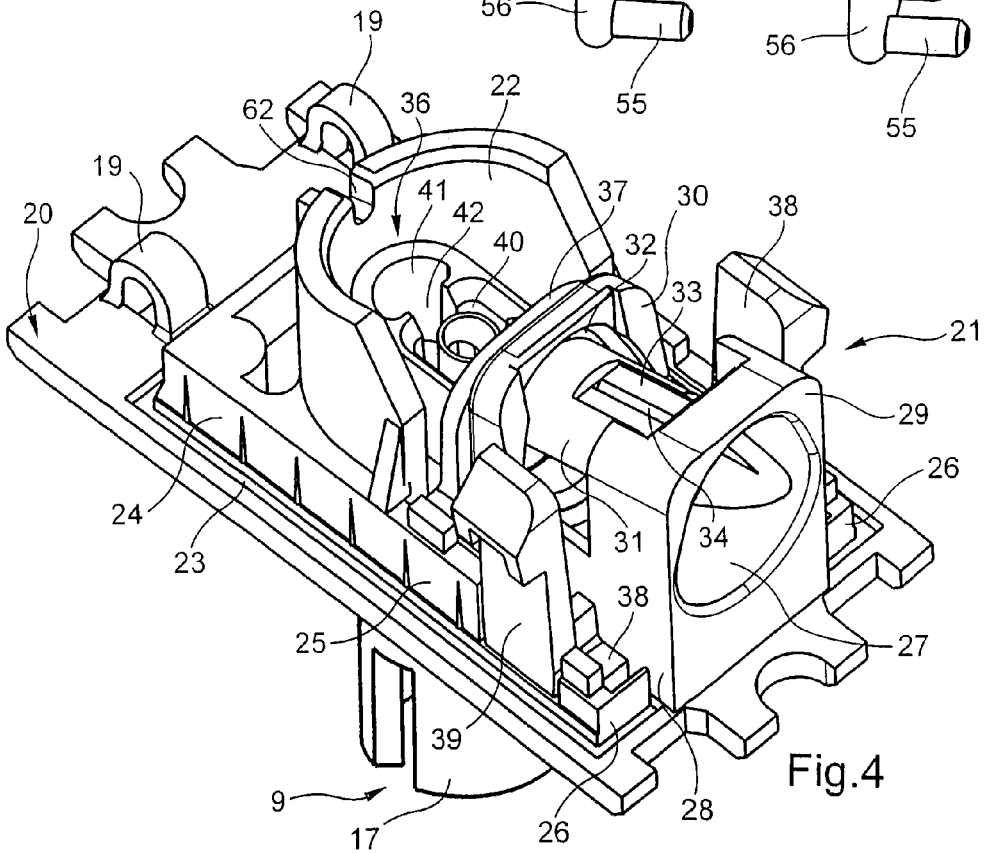
FIG. 4 is a perspective view of the assembled base.

As may be seen more particularly in FIG. 4, the blade 31 has a flat 33 extending between the arch 29 and the arch 30 opposite the plate 15, i.e. on its convex side.

At the center of the flat 33 is a groove 34 extending in the longitudinal direction. The groove 34 has a V-shaped profile.

The portion of the blade 31 situated between the arches 29 and 30 is accessible from the outside of the cage 21, both from opposite the cradle 28 and laterally from each side.

The insert 11 is molded from an insulative plastic material.

It comprises a foot 35, a head 36, a shield 37, two arms 38 and two clips 39.

The foot 35 and the head 36 are oriented in the axial direction and are aligned with each other.

As may be seen more particularly in FIGS. 4 and 5, the head 36 and the shield 37 delimit a compartment 40 into which a bore in the foot 35 opens. Opposite the shield 37, the head 36 delimits another compartment 41. A central passage 42 is formed between the compartment 40 and the compartment 41.

A hole 43 in the shield 37 provides a passage between the compartment 40 and the outside.

The passage 42 and the hole 43 are centered on the longitudinal plane of symmetry of the insert 11.

The arms 38 are oriented in the longitudinal direction. Each is rooted at one end at the junction between the foot 35, the head 36 and the shield 37. They project from the shield 37 on the side opposite the compartment 41.

The distance between the arms 38 substantially corresponds to the width of the cage 21.

The clips 39 are oriented in the axial direction. Each is rooted laterally on the outside of one of the arms 38, opposite the shield 37. Each clip 39 projects from the arm 38 to which it is attached, on the same side as the head 36 and the shield 37.

At the distal end of each of the arms 39 is a detent 44.

The contact terminal 12 is a relatively flexible conformed conductive metal strip.

The terminal 12 is oriented in the axial direction. It comprises a tail 45, a lyre contact 46 and a connecting bridge 47 between the tail 45 and the lyre contact 46.

The tail 45 is globally tubular and has a slot 48 oriented in the axial direction running its whole length.

The lyre contact 46 comprises two lips 49 with a globally V-shaped profile. The tops of the lips 49 are oriented in the axial direction and are substantially aligned with the slot 48.

There is a hole 50 in the lyre contact 46 opposite the lips 49 (FIG. 5).

The insert 11 is simply nested in the body 10.

In the assembled state, the foot 35 is housed in the tubular member 17 and the opening 18, the head 36 is surrounded by the partition 22 and by the cage 21, with the shield 37 disposed against the arch 30, and the arms 38 are disposed between the cage 21 and the walls 25 and 26 against the face 20. The root of the clips 39 is disposed between the walls 25 and 26 and the detents 44 are in the space between the arches 29 and 30.

The contact terminal 12 is also nested in the body 2, to be more precise in the insert 11. In the assembled state (FIGS. 4 and 5) the lyre contact 46 is disposed in the compartment 40, the bridge 47 and a portion of the tail 45 are disposed in the bore in the foot 35, and the remainder of the tail 45 projects from the foot 35 into the tubular member 17.

The lips 49 of the lyre contact 46 face the shield 37 and are centered relative to the hole 43.

The passage 42, the hole 50, the lips 49 and the hole 43 are centered in the longitudinal plane of symmetry of the body 2 with the holes 43 and 50 aligned with the compartment 27, i.e. centered on the same axis 51 (FIG. 5).

The cover 3 is cast from a conductive metal.

Its overall shape is that of a parallelepipedal box.

The edge surface of its lateral wall has substantially the same conformation as the groove 23 of the body 10.

In the vicinity of one of the shorter sides of the edge surface of the lateral wall, the cap 3 has on the outside two aligned pins 55 oriented in the transverse direction. Each pin 55 projects from a rib 56 itself projecting from the lateral wall of the cap 3, to be more precise from a section of that lateral wall oriented in the transverse direction.

The opposite section of the lateral wall, i.e. the other section of this wall that is oriented in the transverse direction, has a central opening 57 whose contour corresponds to that of the cage 21 at the level of the arch 29.

Each of the sections of the lateral wall of the cap 3 oriented in the longitudinal direction has an aperture 58 in the vicinity of the transverse section in which the opening 57 is formed.

The apertures 58 are substantially the same width as the clips 39. They extend from a surface 59 parallel to the edge surface of the lateral wall to the back wall of the cap 3, in which the apertures 58 are partly formed.

A central rib 61 oriented in the longitudinal direction projects from the inside face 60 of the back wall of the cap 3. The rib 61 is the same width as a notch 62 in the partition 22 of the body 10.

A U-shaped profile rib 63 also projects from the face 60 of the back wall of the cap 3. The curved portion of the rib 63 has an external contour corresponding substantially to the internal contour of the partition 22.

Another rib 64 that is slightly curved but generally oriented in the transverse direction projects from the face 60 and is joined at each end to one of the ends of the rib 63.

The distance between the end of the rib 61 on the same side as the ribs 63 and 64 corresponds to the distance between the notch 62 and the edge surface of the shield 37.

An arcuate rib 65 oriented in the transverse direction projects from the face 60 and is disposed against the rib 64, on the side opposite the rib 63.

Two claws 66 projecting from the wall 60 each have a pointed end. The claws 66 are between the opening 57 and the rib 65 and are centered in the longitudinal plane of symmetry of the cap 3. Two lugs 67 project from the face 60 on respective opposite sides of the claws 66, at the same level as the apertures 58.

The facing faces of the lugs 67 have a V-shaped profile. They have a relatively sharp edge 68 at each end, at the junction with a lateral face.

The cap 3 also has a groove 69 (FIG. 1) recessed with respect to the outside face of its back wall and whose width substantially corresponds to that of the central core 8 of the cable 4. The length of the groove 69 corresponds to that over which it is necessary to bare the core 8, as explained later. The groove 69 therefore provides the user with a template enabling him to tell if the bared portion of the core 8 is the required length.

The base 2 and the cap 3 are assembled simply by inserting the pins 55 into the hinge members 19.

The cooperation of the pins 55 and the hinge members 19 provides an articulation between the base 2 and the cap 3 about a pivot axis oriented in the transverse direction in the vicinity of the transverse edge of the plate 15 opposite that at the same end as the entry mouth into the compartment 27.

The cap 3 may therefore pivot relative to the base 2 between the raised position shown in FIG. 2 and the closed position shown in FIG. 1.

How a coaxial cable 4 is connected to the connection device 1 is described next.

The end of the cable 4 is first bared as far as the central core 8 over a predetermined length corresponding to the lengths of the groove 69, as shown in FIG. 2.

Then, with the cap 3 raised, the cable 4 is forcibly inserted as far as possible into the compartment 27, so that the contact blade 31 spears it between its outer jacket 5 and its braid 6.

As this happens, the central core 8 of the cable 4 passes through the hole 43 in the shield 37, becomes engaged between the lips 49 of the lyre contact 46 of the contact terminal 12 and then a portion 8 of the bared core 8 passes or not through the hole 50, depending on the bared length and how far the cable 4 is pushed into the compartment 27, and is accommodated in the passage 42 and in the compartment 41, as shown in FIG. 5.

By looking at the lyre contact 46, the operator can check visually that the core 8 is correctly in place.

To complete the connection of the cable 4, it then suffices to pivot the cap 3 to the position shown in FIGS. 1 and 5.

At the end of the pivoting movement of the cap 3, the claws 66 penetrate the outer jacket 5 of the cable 4 and the detents 44 on the clips 39 fit into the apertures 58.

In the closed position (FIGS. 1 and 5), the cap 3 is locked to the base 2 by the clips 39, the right-angle face of the detent 44 on each of the clips 39 then being against the face 59 of the corresponding aperture 58.

The cable 4 is retained in the device 1 by the claws 66 and by the lugs 67, each of which is disposed in one of the lateral spaces between the arches 29 and 30, the sharp edges 68 being pressed against the outer jacket 5 and wedging it against the blade 31.

It will be noted that the clipping means, consisting of the clips 39 and the apertures 58, are on respective opposite sides of the retaining members consisting of the claws 66 and the lugs 67, more generally on respective opposite sides of the contact blade 31.

The locking action between the base 2 and the cap 3 is therefore effected as close as possible to these retaining members, which is beneficial to the resulting quality of retention.

The arch 29 of the cage 21 is disposed in the opening 57 with the same contour as the cap 3, the external face of the cage 21 and that of the cap 3 being flush with each other, as may be seen in FIG. 1.

The arch 30 of the cage 21 is nested in the hollow of the rib 65. The rib 64 is placed against the edge surface of the shield 37 and the rib 63 is nested against the top of the partition 22, on its inside.

The edge surface of the lateral wall of the cap 3 is disposed against the face 20, around the groove 23, which receives a tongue 52 running along the inside edge of the edge surface of the lateral wall of the cap 3 and projecting relative to that edge surface.

It will be noted that the back wall of the cap 3 forms with the ribs 63 and 64 a kind of dome which, with the partition 22, forms a shell enveloping the bared portion of the central core 8 and the lyre contact 46 of the contact terminal 12 to ensure good continuity between the shielding braid 6 of the cable 4 and the shielding provided by the device 1. This continuity is beneficial to the performance of the device 1, in particular with regard to electromagnetic compatibility (EMC).

Finally, the groove 61 is accommodated in the notch 62, their cooperation during the closing of the cap 3 centering the latter relative to the body 2.

In the embodiment shown in FIGS. 1 to 5, the connector 9 is of the female IEC type, the tubular member 17 being adapted to receive the tubular member of a corresponding plug inside it and the tail 45 being adapted to receive the pin of the plug inside it.

Figure 6:
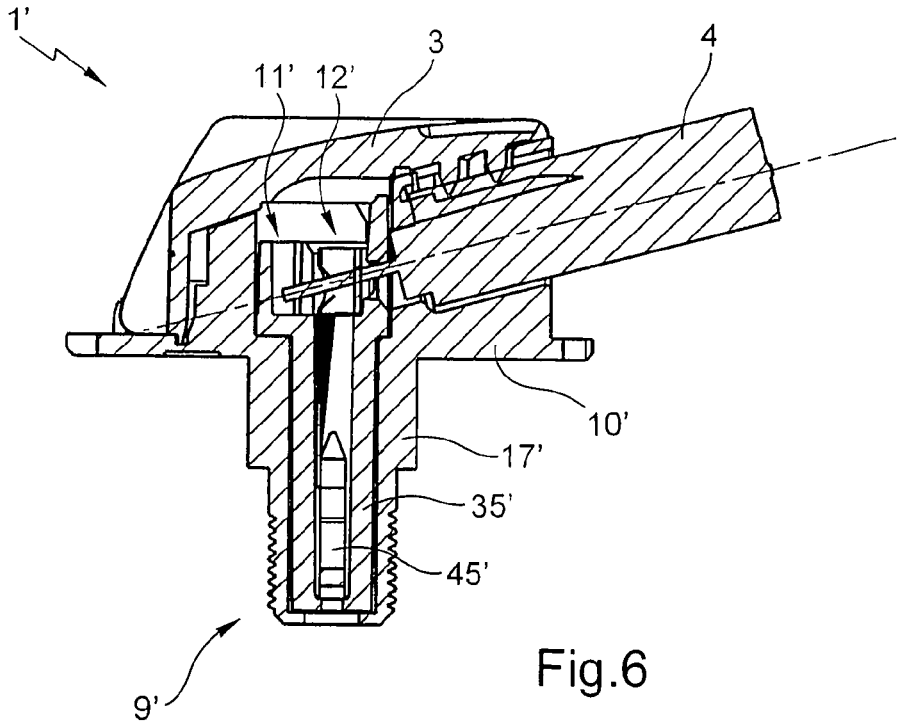
FIG. 6 is a view similar to FIG. 5 for a variant of the device in which the connector is an F connector rather than a female IEC connector.

The variant 1' of the device 1 shown in FIG. 6 is identical except that the connector 9 is replaced by an F-type connector 9'.

To be more precise, the body 10 is replaced by a body 10' in which the tubular member 17 is replaced by a tubular member 17' having an external screwthread, the insert 11 is replaced by an insert 11' in which the foot 35 is replaced by a foot 35' extending the whole length of the tubular member 17', and the terminal 12 is replaced by a terminal 12' in which the tail 45 is replaced by a tail 45' adapted to receive inside it a bared end portion of the central core of a coaxial cable.

In a variant that is not shown, the connector 9 is replaced by a male IEC connector or by a connector of some other type.

In other variants which are not shown, the number of claws like the claws 66 is different, i.e. there is only one claw or more than two claws; likewise the lugs 67; there is only type of retaining member like the claws 66 and the lugs 67 or more than two types; and/or the retaining members opposite the contact blades such as 31 on the insulative outer jacket 5 and providing a grip are shaped differently.

In further variants of the device 1 that are not shown, it is not integrated into a wall-mounted socket but into some other form of connection device, for example a plug to be fitted to one end of a coaxial cable. In this latter case, and moreover in other variants, the connector such as 9 or 9' is aligned with the compartment such as 27, not at right angles to it; the cap such as 3 is articulated about a pivot axis situated elsewhere than at the opposite end to the entry mouth into the compartment such as 27, for example at the same end as the entry mouth; the cap such as 3 is replaced by a cap that is not articulated to the base such as 2, for example a separate cap merely clipped to the base such as 2; and/or the body such as 10 and the cap such as 3 are made from a conductive material other than a metal, for example from a plastic material covered with a conductive film.

Numerous other variants are possible as a function of circumstances, and in this connection it is pointed out that the invention is not limited to the examples described and shown.

What is claimed is:

1. A coaxial cable connection device comprising:

a base having compartment adapted for direct insertion of a previously partially bared end of a coaxial cable to be connected;

a contact blade connected to said base and being in said compartment elongate in the same direction as said compartment and adapted to longitudinally spear said coaxial cable between an outer jacket thereof and a shield thereof;

a contact terminal with which said central core of said coaxial cable is adapted to be engaged; and a cap adapted to be fixed to said base in a closed position of said device and comprising a retaining member in the immediate vicinity of said contact blade in said closed position, said retaining member is adapted, in said closed position, to grip said outer jacket of a cable speared on said blade on the side opposite said blade.

2. The device claimed in claim 1 comprising two retaining members each formed by a lug having a sharp edge oriented, in said closed position, in a direction transverse to the direction of said compartment, said two lugs being situated on respective opposite sides of said contact blade in said closed position.

3. The device claimed in claim 1 comprising four retaining members respectively formed by two claws having a pointed end centered in a longitudinal plane of symmetry of said cap and two lugs each having a sharp edge oriented, in said closed position, in a direction transverse to the direction of said compartment.

4. The device claimed in claim 1 wherein either said base or said cap comprises a rib accommodated in a groove or notch in said base or said cap, respectively.

5. The device claimed in claim 1 wherein said retaining member is a lug having sharp edge oriented, in said closed position, in a direction transverse to the direction of said compartment.

6. The device claimed in claim 5 wherein each lug has two sharp edges disposed at a distance from each other.

7. The device claimed in claim 1 wherein said retaining member is a claw having a pointed end.

8. The device claimed in claim 7 wherein said contact blade has a flat facing each claw.

9. The device claimed in claim 8 wherein said flat comprises a central V-shaped profile groove.

10. The device claimed in claim 1 wherein said base and said cap are articulated to each other, said device having an open position in which said cap is raised relative to said base, said cap being pivoted onto said base in said closed position.

11. The device claimed in claim 10 wherein said base and said cap are articulated on the side opposite said compartment.

12. The device claimed in claim 10 wherein said base and said cap are articulated in a direction transverse to the direction of said compartment.

13. The device claimed in claim 10 wherein said base and said cap are articulated by hinge members that are part of said base and pins that are part of said cap.

14. The device claimed in claim 1 wherein said contact terminal is part of said base which comprises a conductive material partition at least partially surrounding a portion of said contact terminal in which said central core is adapted to be engaged.

15. The device claimed in claim 14 wherein said partition faces, on the inside, a conductive portion of said base and said cap comprises a wall in which one end of said portion nests in said closed position.

16. The device claimed in claim 14 wherein said cap has a portion forming a dome fitting to one of the ends of said partition in said closed position.

17. The device claimed in claim 16 wherein said cap portion forming a dome comprises a portion of a back wall and a rib.

18. The device claimed in claim 1 wherein said compartment is delimited by a cage comprising a cradle and a first arch and a second arch offset from each other.

19. The device claimed in claim 18 wherein said contact blade has the general shape of a fingernail whose concave side faces said cradle and whose convex side faces said first and second arches.

20. The device claimed in claim 18 wherein said retaining member is between said first arch and said second arch in the immediate vicinity of said contact blade in said closed position.

21. The device claimed in claim 18 wherein said cradle and said first arch delimit an entry mouth into said compartment.

22. The device claimed in claim 21 wherein said second arch carries said contact blade.

23. The device claimed in claim 22 wherein said contact blade is attached to said second arch by a bridge.

24. The device claimed in claim 1 wherein said base and said cap comprise clipping members for fixing them to each other in said closed position.

25. The device claimed in claim 24 wherein said clipping members are situated on respective opposite sides of said contact blade.

26. The device claimed in claim 24 wherein said clipping members comprise clips forming part of said base.

27. The device claimed in claim 26 wherein said clips form part of a molded plastic material insert of said base.

28. The device claimed in claim 27 wherein said insert comprises a portion disposed between a metal body of said base and said contact terminal, which is part of said base.

29. The device claimed in claim 1 wherein said contact terminal comprises a lyre contact adapted to interengage said central core of said cable and a tail forming part of a receptacle for receiving a coaxial cable connection plug.

30. The device claimed in claim 29 wherein said contact terminal is oriented in a direction transverse to the direction of said compartment.

31. The device claimed in claim 29 wherein said receptacle comprises a tubular member in which said tail is engaged and said base comprises an insulative material insert disposed between a body of which said tubular member is part and said contact terminal.

32. The device claimed in claim 31 wherein said insert comprises a foot accommodated in said tubular member and a head in which said lyre contact is accommodated.

33. The device claimed in claim 32 wherein said head comprises a first compartment in which said lyre contact is accommodated and a second compartment connected to said first compartment by a passage.

34. The device claimed in claim 33 wherein said insert comprises a shield connected to said head on the same side as said first compartment and a hole is formed in said shield through which said conductive core of said coaxial cable is passed.

35. A coaxial cable connection device comprising:

a compartment adapted for direct insertion of a previously partially bared end of a coaxial cable to be connected;

a contact blade in said compartment elongate in the said direction as said compartment and adapted to spear said coaxial cable between an outer jacket thereof and a shield thereof;

a contact terminal with which said central core of said coaxial cable is adapted to be engaged, a base of which said contact blade is part; and a cap adapted to be fixed to said base in a closed position of said device and comprising two retaining members in the immediate vicinity of said contact blade in said closed position, said retaining members are each formed by a claw having a pointed end and are adapted, in said closed position, to grip said outer jacket of a cable speared on said blade on the side opposite said blade, wherein said two claws are centered in a longitudinal plane of symmetry of said cap.

36. A coaxial cable connection device comprising:

a base having a compartment adapted for receiving a previously partially bared end of a coaxial cable to be connected;

an elongate blade in said compartment adapted to pierce said coaxial cable between an outer jacket thereof and a shield thereof without penetrating the outer jacket;

a contact terminal that contacts a central core of said coaxial cable; and a cap removable fixable to said base and comprising a retaining member that is adjacent said elongate blade, when said cap is in a closed position, to grip said outer jacket of a cable pierced by said blade.

* * * * *